US007115153B2

(12) United States Patent
Ahlborn et al.

(10) Patent No.: US 7,115,153 B2
(45) Date of Patent: Oct. 3, 2006

(54) ELECTRIC SEPARATOR WITH A RINSING CLEANING SYSTEM

(75) Inventors: Stephan Ahlborn, Senden (DE); Dieter Baumann, Greven (DE); Bernhard Batram, Greven (DE)

(73) Assignee: Hengst GmbH & Co. KG, Muenster (DE)

( * ) Notice: Subject to any disclaimer, the term of this patent is extended or adjusted under 35 U.S.C. 154(b) by 0 days.

(21) Appl. No.: 11/032,046

(22) Filed: Jan. 11, 2005

(65) Prior Publication Data

US 2005/0115406 A1 Jun. 2, 2005

Related U.S. Application Data

(63) Continuation of application No. PCT/DE2003/002306, filed on Jul. 9, 2003.

(30) Foreign Application Priority Data

Jul. 12, 2002 (DE) ..... 202 11 439 U

(51) Int. Cl.
*B03C 3/78* (2006.01)

(52) U.S. Cl. ..... 95/74; 95/75; 96/44; 96/49; 96/50; 96/51

(58) Field of Classification Search ..... 96/44, 96/45, 47, 49–51, 75, 76, 43, 46, 48
See application file for complete search history.

(56) References Cited

U.S. PATENT DOCUMENTS

| | | | | |
|---|---|---|---|---|
| 1,959,752 | A * | 5/1934 | Wintermute | 96/49 |
| 2,192,172 | A * | 3/1940 | Anderson | 95/75 |
| 2,192,249 | A * | 3/1940 | White | 95/75 |
| 2,937,709 | A * | 5/1960 | De Seversky | 96/45 |
| 3,551,674 | A * | 12/1970 | Strindehag | 250/361 R |
| 3,818,678 | A * | 6/1974 | Gothard | 95/75 |
| 4,529,418 | A * | 7/1985 | Reif et al. | 96/45 |
| 5,066,316 | A | 11/1991 | Ikeda | 96/52 |
| 5,626,652 | A * | 5/1997 | Kohl et al. | 96/45 |
| 5,698,012 | A * | 12/1997 | Yoshikawa | 96/47 |
| 5,843,210 | A * | 12/1998 | Paranjpe et al. | 95/59 |
| 5,968,231 | A * | 10/1999 | Parmentier et al. | 95/28 |
| 6,228,148 | B1 * | 5/2001 | Aaltonen et al. | 95/74 |
| 6,254,668 | B1 * | 7/2001 | Huang | 96/18 |
| 6,294,003 | B1 * | 9/2001 | Ray | 96/49 |
| 6,348,103 | B1 * | 2/2002 | Ahlborn et al. | 134/6 |
| 6,365,112 | B1 * | 4/2002 | Babko-Malyi et al. | 422/186.04 |
| 6,506,232 | B1 * | 1/2003 | Menear | 95/59 |
| 6,530,981 | B1 * | 3/2003 | Stivers | 96/44 |
| 6,533,841 | B1 * | 3/2003 | Jepsen | 95/75 |

(Continued)

FOREIGN PATENT DOCUMENTS

DE 1039037 3/1959

(Continued)

OTHER PUBLICATIONS

English Language Abstract of JP 2002-119889.

*Primary Examiner*—Richard L. Chiesa
(74) *Attorney, Agent, or Firm*—Greenblum & Bernstein, P.L.C.

(57) ABSTRACT

Electric oil separator that separates oil from an airflow of a ventilator. The separator includes an emission electrode and a collecting electrode. Moreover, the separator includes an injection device structured and arranged to inject oil as a cleaning fluid onto at least one of the emission electrode and the collecting electrode, so as to inject oil obliquely to a longitudinal axis of the collecting electrode.

21 Claims, 7 Drawing Sheets

U.S. PATENT DOCUMENTS

| | | | | |
|---|---|---|---|---|
| 6,635,105 | B1 * | 10/2003 | Ahlborn et al. | 96/28 |
| 2002/0129704 | A1 * | 9/2002 | Menear | 95/57 |
| 2005/0115406 | A1 * | 6/2005 | Ahlborn et al. | 95/74 |

FOREIGN PATENT DOCUMENTS

| | | | | |
|---|---|---|---|---|
| DE | 2743292 | | 3/1979 | |
| DE | 4415407 | | 11/1995 | |
| DE | 19610137 | | 9/1997 | |
| DE | 19822332 | | 5/1999 | |
| DE | 29905302 | | 7/1999 | |
| EP | 0685635 | | 12/1995 | |
| GB | 930282 | | 7/1963 | |
| JP | 61-164660 | * | 7/1986 | 96/44 |
| JP | 2002-119889 | | 4/2002 | |
| WO | WO 99/01224 | * | 1/1999 | |
| WO | WO 99/59724 | * | 11/1999 | |

* cited by examiner

ELECTRIC SEPARATOR WITH A RINSING CLEANING SYSTEM

CROSS-REFERENCE TO RELATED APPLICATIONS

The present application is a Continuation of International Application No. PCT/DE2003/002306, filed Jul. 9, 2003 and claims priority of German Patent Application No. 202 11 439.2, filed on Jul. 12, 2002. Moreover, the disclosure of International Patent Application No. PCT/DE2003/002306, filed Jul. 9, 2003 is expressly incorporated by reference herein in its entirety.

BACKGROUND OF THE INVENTION

1. Field of the Invention

The invention relates to an electric separator for separating oil from an airflow of a crankcase ventilator of an internal combustion engine, with an emission electrode and with a collecting electrode.

2. Discussion of Background Information

A generic electric separator is known from DE-U-299 053 02.

If one or both electrodes of the separator are to be freed from impurities adhering, a problem can exist that when mechanical cleaning installations are used, it is not possible to effectively remove hardened deposits. Since the mechanical cleaning installations are operated intermittently, depending on the operating mode of the internal combustion engine, an interval between two cleaning operations can be so great that the deposits in the separator harden in the above-mentioned disadvantageous manner.

SUMMARY OF THE INVENTION

An aspect of the present invention is to improve a generic electric separator so that it renders possible a reliable electrode cleaning.

This aspect is achieved with an electric separator for separating oil from the airflow of the crankcase ventilator of an internal combustion engine, with an emission electrode and with a collecting electrode. Moreover, an injection device is provided which injects a cleaning fluid into the separator onto at least one of the two electrodes.

In other words, the invention surprisingly proposes not conducting a mechanical cleaning, but rather a hydraulic cleaning in which the deposits are removed in at least one of the two electrodes by a fluid. Surprisingly, it has been proven that, despite the lighter mechanical impact with which the fluid acts on the deposits compared to a brush-shaped cleaning body, a reliable cleaning of the electrode is possible in that the electrode surfaces are actually rinsed.

Advantageously, oil can be used as the fluid for cleaning the electrode surfaces, in particular oil that is taken from the oil circuit of the internal combustion engine. Although the electric separator is used to remove oil from the airflow, surprisingly and unexpectedly the additional introduction of oil of all things into the airflow is expedient, namely to clean the electrode surface because in this manner the expense for operating the electric separator can be kept relatively low compared to the requirement to use a special cleaning fluid and to stock the same and regularly refill it. Moreover, because good cleaning results can be achieved when oil is used as a rinsing fluid, evidently a high affinity exists to the deposits likewise originating from the oil, so that oil as a rinsing fluid picks up and carries away the deposits particularly well when the oil runs along the electrode surface.

Electric separators of a different generic type are known from DE 27 43 292 B2 which are used in an industrial installation and are therefore not subject either to the requirements regarding structural dimensions or to the stresses in terms of temperature and vibration that occur in the case of generic electric separators, in particular if the internal combustion engine is provided as a drive in a motor vehicle. It is known from this above-mentioned prior art of a different generic type to provide an injection of water in order to form a fluid film on a collecting surface. The collecting surface does not thereby represent the collecting electrode but merely a type of carrier or holder for the fluid film, whereas the actual collecting electrode is formed by the liquid film itself which is in contact with an electric conductor and is grounded by it. In this known prior art, in particular the material itself which is to be removed by the separator from an airflow is not used as the fluid.

The spray jet of the injection device can be advantageously directed at the wall of the electrode, thereby either the spray jet as a high-pressure jet can render possible an additional reinforcement of the cleaning performance. Due to the atomization effect that may possibly occur thereby, in these cases it can be provided to carry out such an injection operation only when the air speed in the electric separator is low. In this way the tendency of the air jet to entrain atomized oil particles during the injection operation is particularly slight, so that the separation performance of the electric separator is not inadmissibly impaired through the injection operation of the cleaning fluid.

Alternatively, it can be provided to direct the spray jet of the injection device tangentially at the wall of the electrode. In this way, a low-atomization spray surge is rendered possible which primarily serves to rinse and wet the electrode surface and renders possible at the most to a secondary extent a cleaning effect through the mechanical pressure of the spray surge.

Advantageously, a circuit can be provided that ensures an actuation of the injection device merely intermittently. While a continuous rinsing of the electrode surface is fundamentally conceivable, which would reliably rule out the deposit of particles on the electrode surface, it can be advantageously provided to carry out the cleaning only under certain operating conditions of the internal combustion engine. In this manner it can be reliably ensured that, e.g., oil does not reach the electrode surface at high engine speeds and accordingly high flow speeds of the air in the separator, which oil would otherwise be entrained due to the high air speed and would impair the separator performance of the electric separator.

The circuit can be controlled, e.g., by an electric engine control or it can be integrated in this engine control so that the injection device for cleaning the electrode surface is activated at preset operating conditions of the engine. To this end an electronically controlled valve can be provided which is actuated by the engine control device. A clocked valve can thereby be provided so that the clock rate can be influenced and the injection quantity of the cleaning fluid can thus be varied.

Alternatively, it can be provided to use a valve which opens or closes, e.g., depending on the pressure conditions in the crankcase purge line or depending on the oil pressure of the engine, so that, independently of the engine control, an opening of the valve can only be ensured under such operating conditions of the engine when the desired low flow speeds of the air prevail in the crankcase ventilator and thus in the electric separator.

One aspect of the present invention includes an electric oil separator that separates oil from an airflow of a ventilator. The separator includes an emission electrode and a collecting electrode. Moreover, the separator includes an injection device structured and arranged to inject oil as a cleaning fluid onto at least one of the emission electrode and the collecting electrode.

In a further aspect of the invention, the ventilator can be a crankcase ventilator of an internal combustion engine. Moreover, an opening can be structured and arranged to direct a jet of the cleaning fluid at a wall of the electrode. Furthermore, the invention can include a circuit configured to intermittently actuate the injection device. Additionally, the circuit can be configured to activate the injection device during a low airflow time-period. The separator can further include a cleaning brush configured to mechanically clean at least one of the emission electrode and the collecting electrode with a cleaning movement, an expansion tank structured and arranged to generate the cleaning movement through a change in a fill volume of the expansion tank, and a supply line structured and arranged to guide a fluid out of the expansion tank to reduce the fill volume and to direct the fluid to one of the injection device and the electrode. Furthermore, a method of using oil as a cleaning fluid for cleaning at least one of the two electrodes can be used with the above noted electric oil separator. Moreover, the method can further include taking the oil from an oil circuit of an internal combustion engine.

Another aspect of the invention includes a method of separating oil from an airflow of a ventilator in an oil separator composed of an emission electrode and a collecting electrode. The method includes injecting oil onto at least one of the emission electrode and the collecting electrode.

In a further aspect of the invention, the ventilator can be a crankcase ventilator of an internal combustion engine. The method can further include directing a jet of the cleaning fluid at a wall of the electrode with a nozzle. Moreover, the method can include intermittently actuating the injection device with a circuit. Furthermore, the circuit can be configured to activate the injection device during a low airflow time-period. The method can also include mechanically cleaning with a cleaning brush to clean at least one of the emission electrode and the collecting electrode with a cleaning movement, generating the cleaning movement through a change in a fill volume of a expansion tank, and guiding a fluid out of the expansion tank to reduce the fill volume and to direct the fluid to one of the injection device and the electrode. Additionally, a cleaner for an electric oil separator that separates oil from an airflow of a ventilator can use the above note method.

In yet another aspect of the invention, an electric oil separator that separates oil from an airflow of a ventilator includes a separator and an injector structured and arranged to inject oil onto a portion of the separator.

In a further aspect of the invention, the ventilator can be a crankcase ventilator of an internal combustion engine. Moreover, the injector, which is coupled to an oil supply through a feed line can include an opening structured and arranged to direct the oil, as a cleaning fluid, at the portion of the separator. The separator can also include a circuit configured to intermittently actuate the injector. Additionally, the circuit can be configured to activate the injector during a low airflow time-period. The separator can further include a cleaning brush configured to mechanically clean the portion of the separator with a cleaning movement, an expansion tank structured and arranged to generate the cleaning movement through a change in a fill volume of the expansion tank, and a supply line structured and arranged to guide a fluid out of the expansion tank and to reduce the fill volume and to direct the fluid to one of the injector and the electrode.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
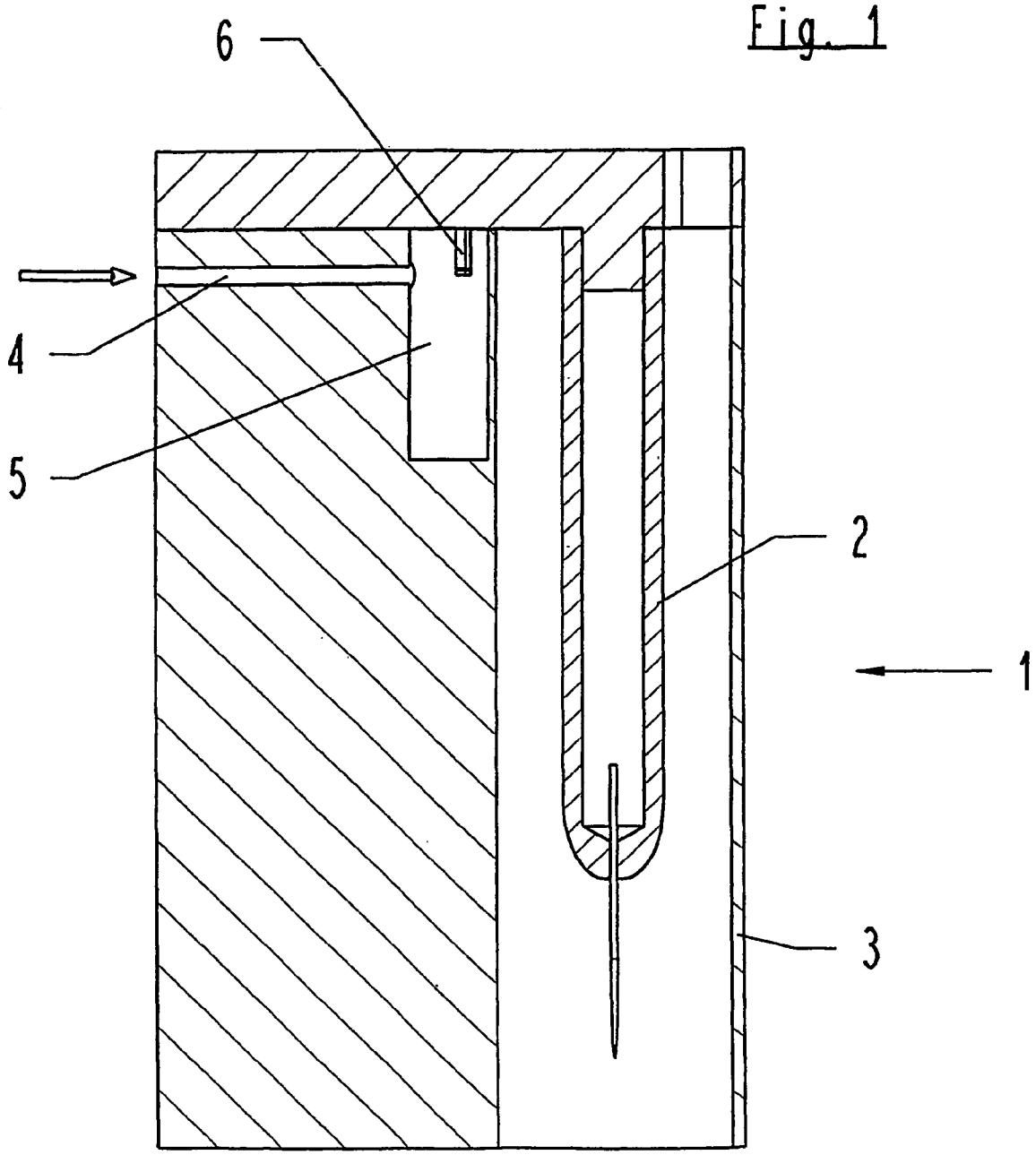
FIG. 1 shows a longitudinal section through an electric separator with three emission electrodes.

In FIG. 1, numeral 1 designates in general an electric separator that is arranged in the airflow of the crankcase ventilator of an internal combustion engine. As can be seen in particular from FIGS. 2 and 3, the separator 1 features three separator chambers in which respectively one emission electrode 2 is arranged and in which the tubular housing surface forms a cylindrical collecting electrode 3.

Oil reaches a distributor bore 5 via a supply line 4, and injection channels 6 lead tangentially from this distributor bore 5 to the collecting electrodes 3. As indicated by the arrows shown in FIGS. 2 and 3, the oil runs in a helical manner downwards on the inner surface of the collecting electrode 3, whereby it is provided in the exemplary embodiment shown that the assembly position according to FIGS. 1 and 3 is oriented with the free end of the emission electrode 2 pointing downwards. Assisted by gravity, the cleaning fluid, in the present case oil from the crankcase of the internal combustion engine, runs downwards on the inner surface of the collecting electrode 3, thereby carrying along the deposits that adhere to the surface of this collecting electrode 3.

With a continuous operation of the injection device, the inner surface of the collecting electrode 3 is always wetted by oil so that from the start no deposits can settle on the collecting electrode 3. In contrast, if the cleaning is carried out only intermittently, the affinity of the deposits originating from the oil to the oil that is used as cleaning fluid ensures that a reliable cleaning of the electrode surface occurs.

Figure 4:
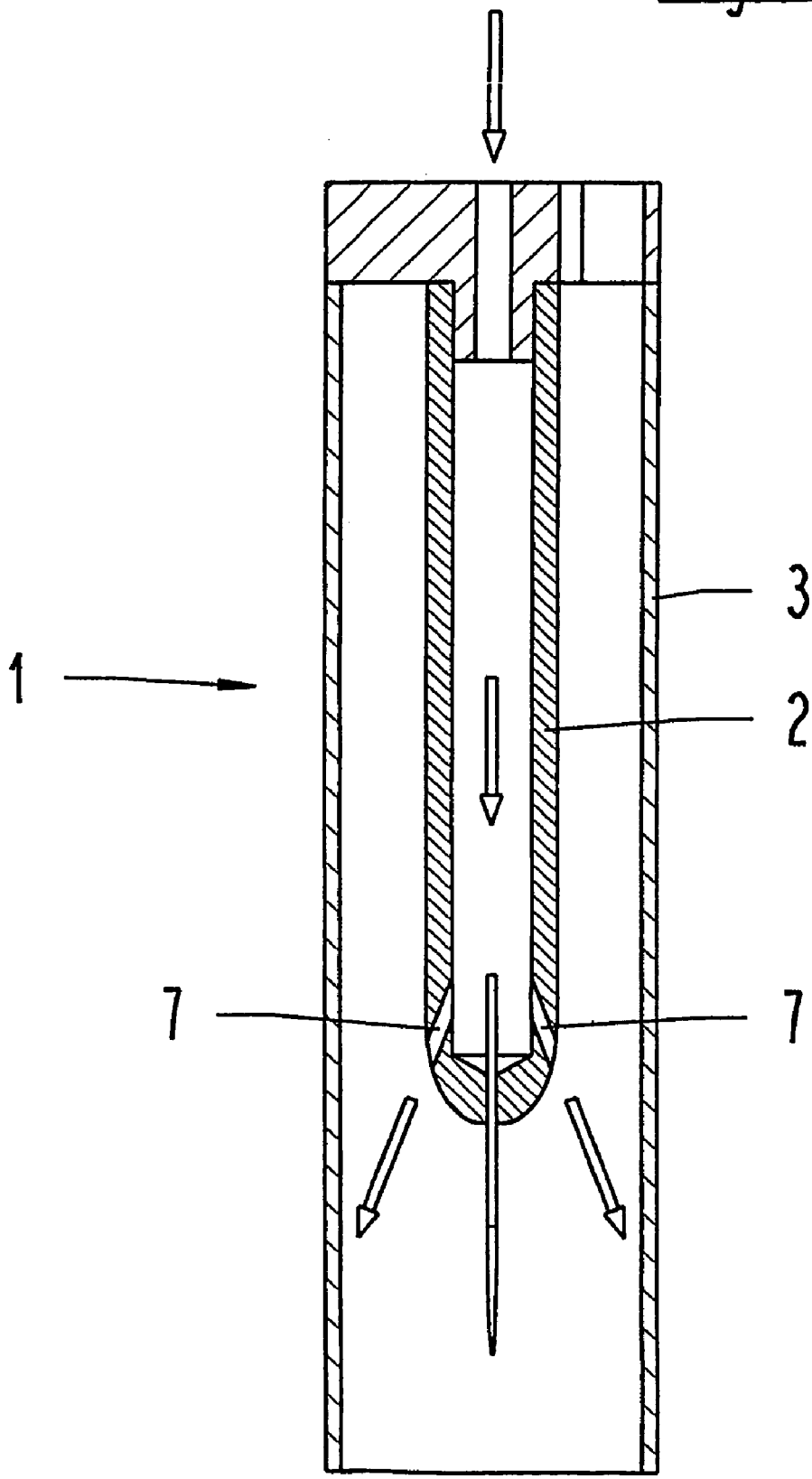
FIGS. 4 and 5 shows two further exemplary embodiments of electric separators.

FIG. 4 shows as a second exemplary embodiment that the oil is guided into the hollow interior of the emission electrode 2 and from there is injected through several cleaning nozzles 7 under relatively high pressure onto the collecting electrode 3, particularly in the area around the free end of the emission electrode 2 where the greatest quantities of deposits occur on the collecting electrode.

In this exemplary embodiment the cleaning fluid does not run along the electrode walls, but has to be injected through the airflow onto the collecting electrode 3. In order to achieve an additional mechanical cleaning effect through viscous friction, the cleaning fluid is injected against the collecting electrode 3 under relatively high pressure. The relatively oblique angle at which the cleaning fluid strikes the collecting electrode 3 and the operation of the cleaning device only when relatively small airflows prevail in the separator 1 jointly ensure that no spray mist of the cleaning fluid is entrained by the airflow and impairs the separator performance. In particular, when motor oil is used as cleaning fluid, which oil in the separator 1 is to be removed from the ventilator of the crankcase.

Figure 2:
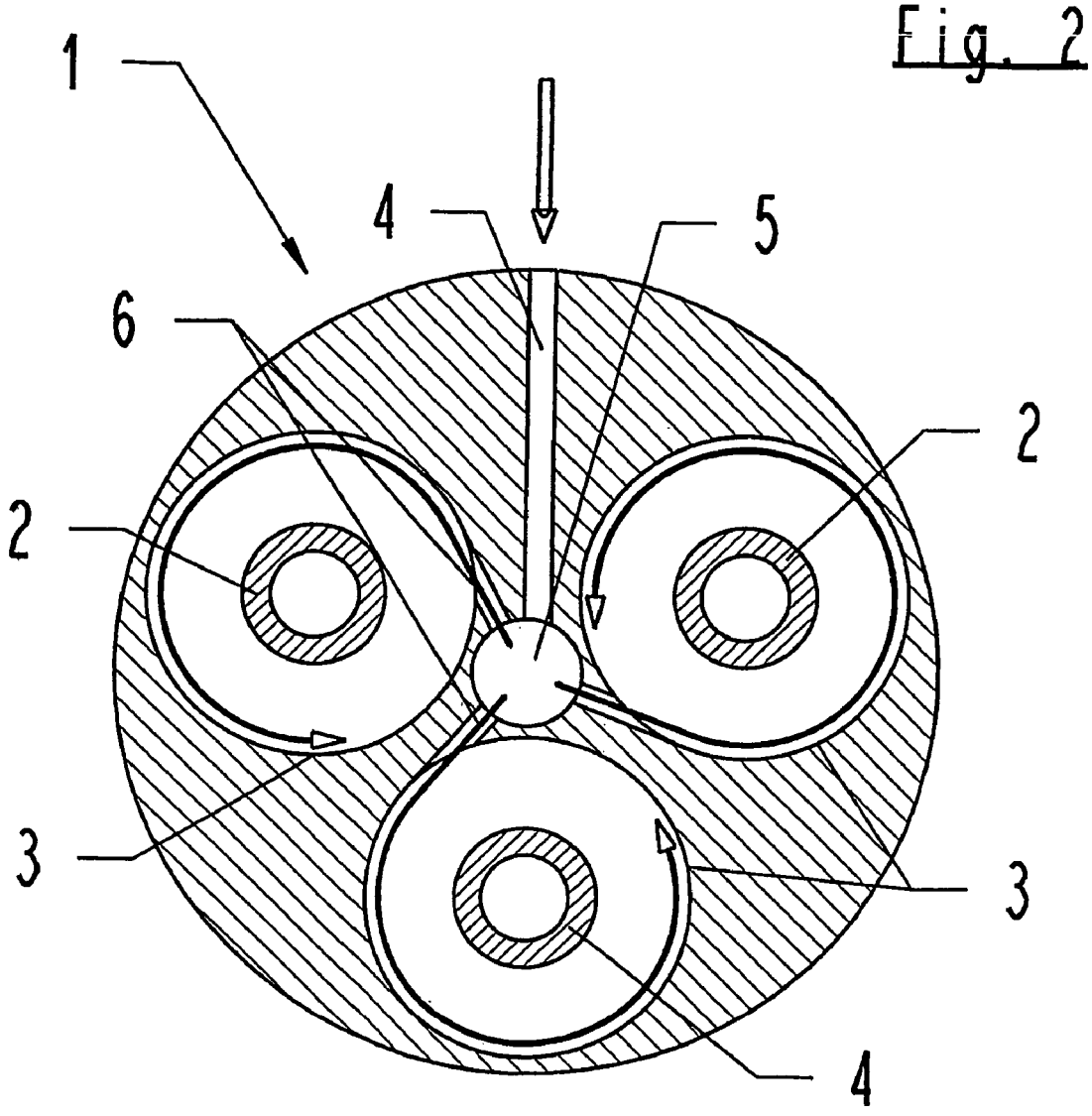
FIG. 2 shows a cross section through the separator of FIG. 1
Figure 3:
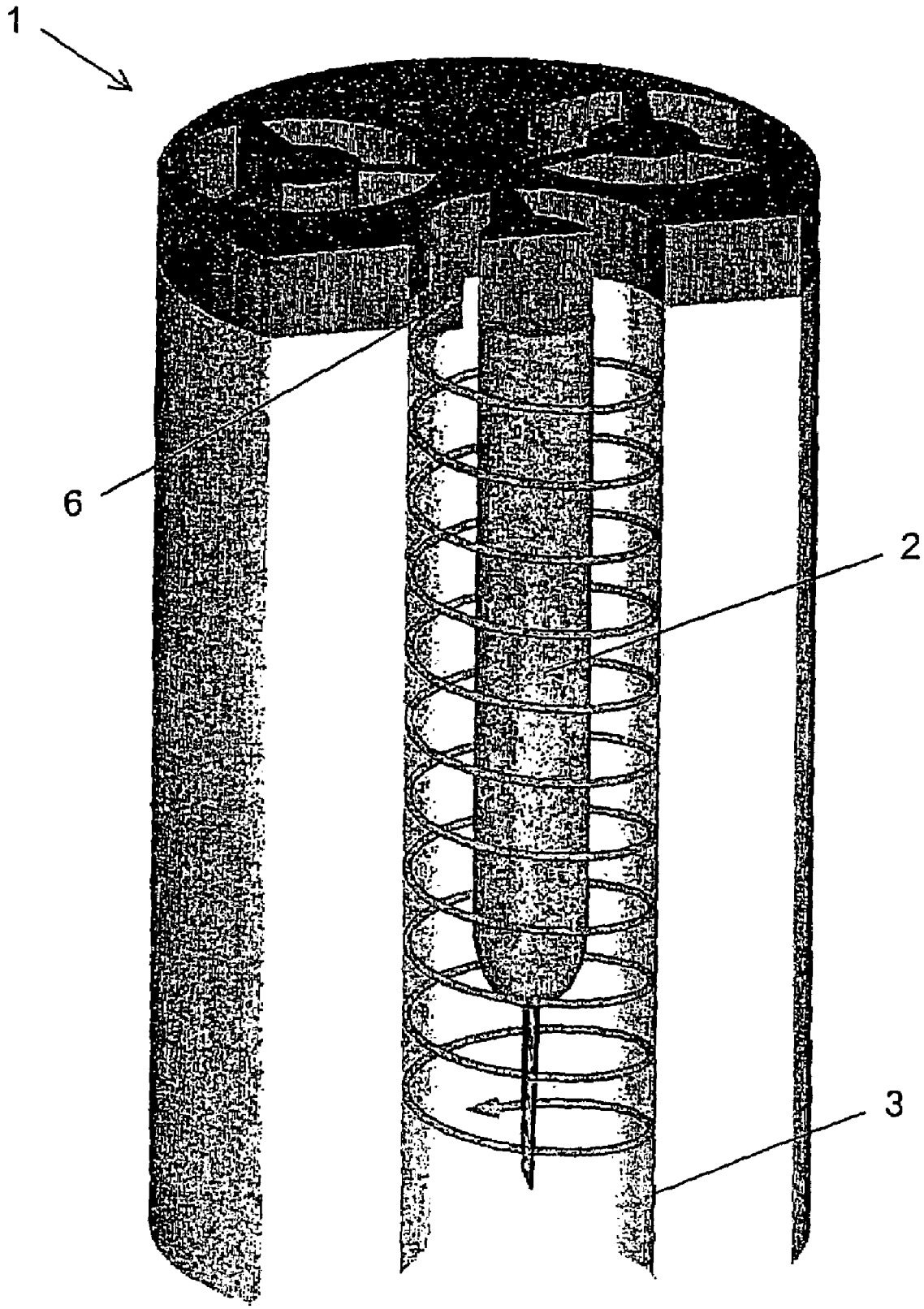
FIG. 3 shows a perspective view, partially in section, of the separator of FIGS. 1 and 2.
Figure 5:
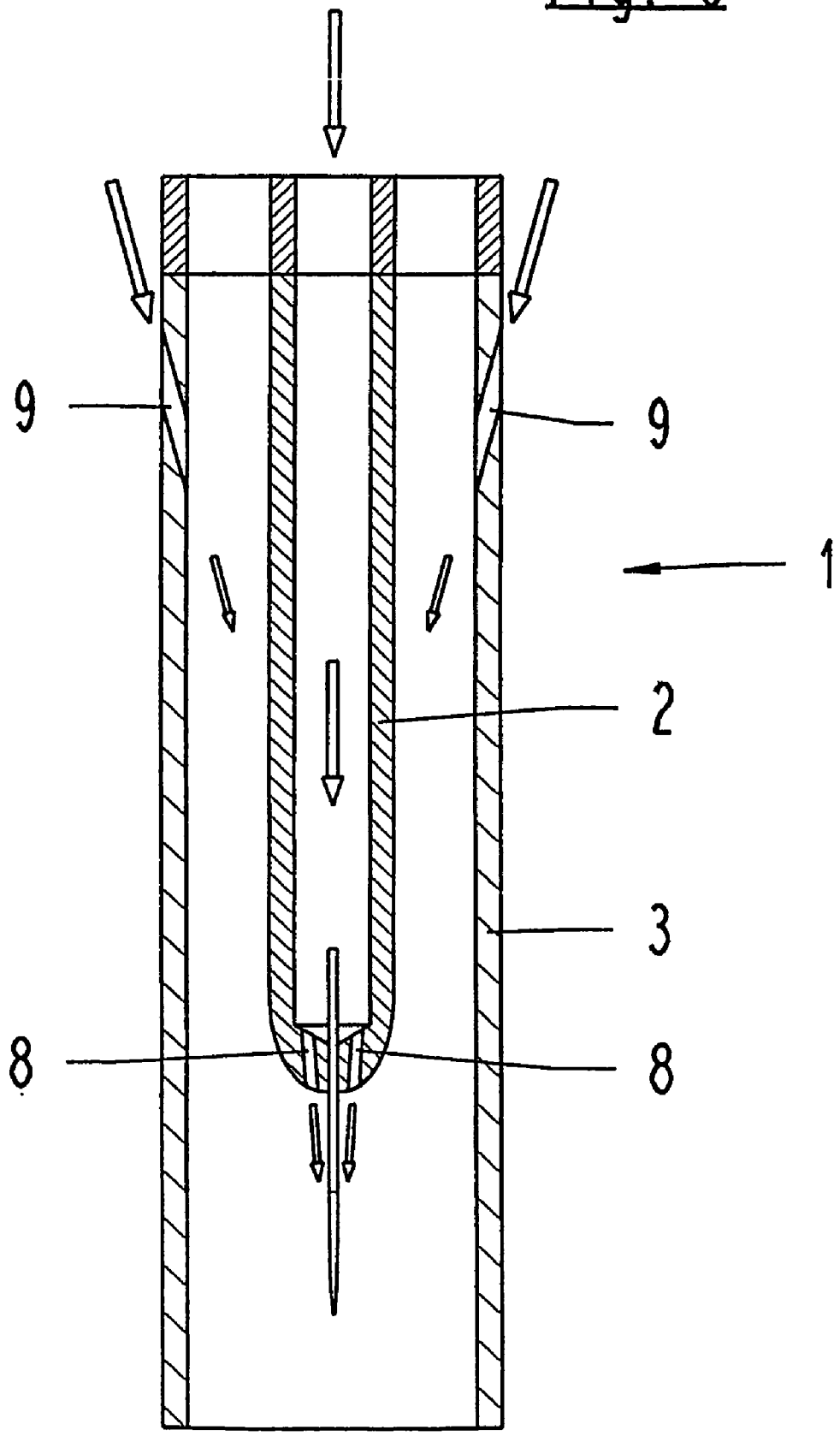

Whereas the exemplary embodiments of FIGS. 1 through 3 always provide a cleaning of the collecting electrode 3, FIG. 5 shows an exemplary embodiment in which the emission electrode 2 is cleaned. In FIG. 5 two different feeds of the cleaning fluid are provided which can be provided either together according to FIG. 5, but also only individually, if necessary, deviating from FIG. 5.

The cleaning fluid can either be guided through the hollow interior of the emission electrode 2 and guided at the lower end of the same through outlet openings 8 to the needle-like tip of the emission electrode 2, and/or the cleaning fluid can be injected onto the emission electrode 2 from outside through injection bores 9, in a similar manner to how the cleaning fluid is injected onto the inner wall of the collecting electrode in the exemplary embodiment according to FIG. 4.

Figure 6:
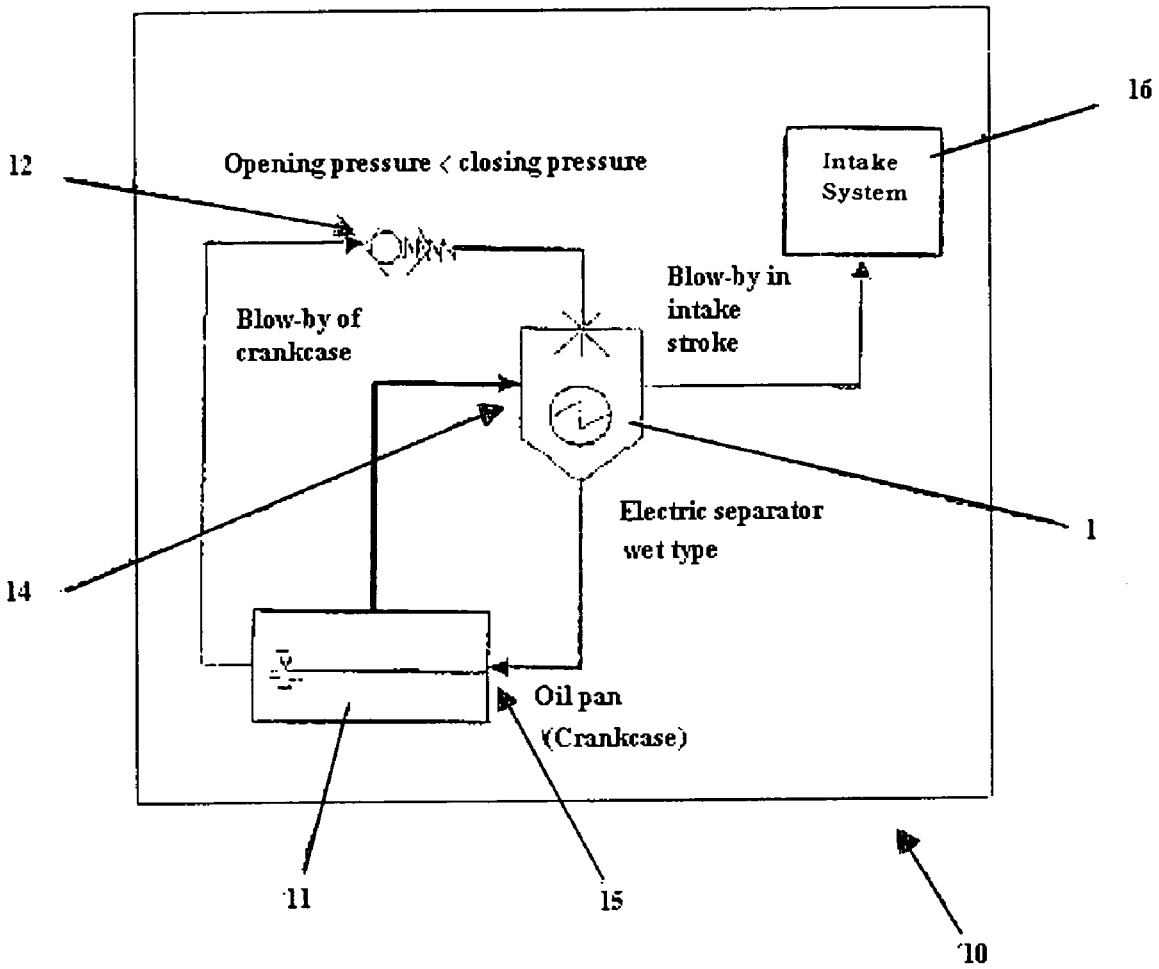
FIGS. 6 and 7 shows two different diagrams of circuits for cleaning the electrodes.

FIG. 6 shows a circuit 10 in which an oil pan 11 of a crankcase of an internal combustion engine is shown in symbolic form. Oil is conveyed out of this oil pan 11 to a valve 12 which opens at a predetermined first pressure P1, but closes again at a predetermined second higher pressure P2. This oil is injected into the electric separator 1 to clean one or both electrodes 2 or 3. The pressure conditions for opening the valve 12 ensure that the valve always opens approximately in the idling operation of the engine, when the flow through speeds of the electric separator 1 are low. As indicated in 14, air is fed to the electric separator from the crankcase, from which air the oil particles are separated.

Whereas the oil resulting from the cleaning and from the separation, as indicated by 15, is fed from the separator 1 back to the oil pan 11, the airflow cleaned of the oil is fed to the intake system 16.

Figure 7:
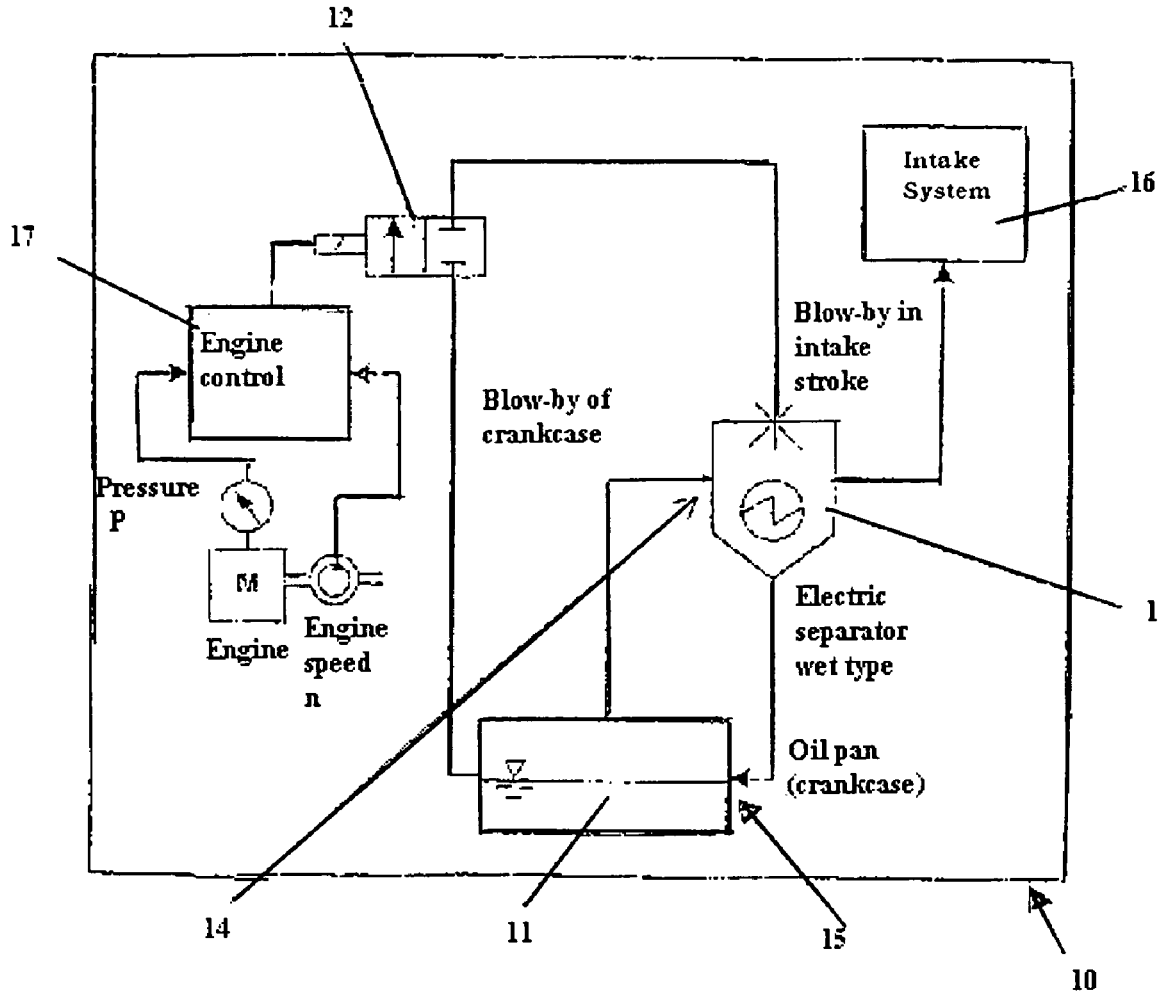

FIG. 7 shows a second exemplary embodiment of a circuit 10 for operating the cleaning device of the separator 1. The valve 12 is not opened here in a directly pressure-dependent manner, but instead is actuated electrically, whereby this actuation is controlled on the basis of the parameters present in an engine control 17. The engine control 17 processes, e.g., parameters such as the engine speed of the internal combustion engine or the pressure prevailing in the oil circuit.

Diverging from the exemplary embodiments shown, it can be provided to use an expansion tank which is filled with a fluid, e.g., in the case of motor oil, whereby the movement of the expansion tank, depending on its filling level, causes a mechanical cleaning element that is connected to the expansion tank to be moved backwards and forwards. This mechanical cleaning element can be embodied, e.g., as a brush, membrane or the like and serve to clean, e.g., the tip of the emission electrode 2. When the expansion tank is emptied, the fluid volume leaving this expansion tank is used as a cleaning fluid for cleaning the respectively other electrode, thus, e.g., the collecting electrode. The expansion tank can thereby easily build up a sufficient pressure in order to render possible, e.g., the relatively low-pressure tangential injection of the cleaning fluid onto the wall of the collecting electrode.

What is claimed is:

1. An electric oil separator that separates oil from an airflow of a ventilator comprising:

an emission electrode;

a collecting electrode; and an injection device structured and arranged to inject oil obliquely to a longitudinal axis of the collecting electrode and as a cleaning fluid onto at least one of the emission electrode and the collecting electrode.

2. The electric oil separator according to claim 1, wherein the ventilator is a crankcase ventilator of an internal combustion engine.

3. The electric oil separator according to claim 1, wherein the injection device, which is coupled to an oil supply through a feed line, further comprises:

an opening structured and arranged to direct a jet of the cleaning fluid at a wall of the electrode.

4. The electric oil separator according to claim 1, further comprising:

a cleaning brush configured to mechanically clean at least one of the emission electrode and the collecting electrode with a cleaning movement;

an expansion tank structured and arranged to generate the cleaning movement through a change in a fill volume of the expansion tank; and a supply line structured and arranged to guide a fluid out of the expansion tank to reduce the fill volume and to direct the fluid to one of the injection device and the electrode.

5. A method of using oil as a cleaning fluid for cleaning at least one of the two electrodes of an electric oil separator according to claim 1.

6. The method according to claim 5, further comprising:

taking the oil from an oil circuit of an internal combustion engine.

7. An electric oil separator that separates oil from an airflow of a ventilator comprising:

an emission electrode;

a collecting electrode;

an oil injection device structured and arranged to inject oil obliquely to a longitudinal axis of the collecting electrode as a cleaning fluid onto at least one of the emission electrode and the collecting electrode; and a circuit configured to intermittently actuate the injection device.

8. The electric oil separator according to claim 7, wherein the circuit is configured to activate the injection device during a low airflow time-period.

9. A method of separating oil from an airflow of a ventilator in an oil separator composed of an emission electrode and a collecting electrode, said method comprising:

injecting oil obliquely to a longitudinal axis of the collecting electrode and onto at least one of the emission electrode and the collecting electrode.

10. The method according to claim 9, wherein the ventilator is a crankcase ventilator of an internal combustion engine.

11. The method according to claim 9 further comprising: directing a jet of the cleaning fluid at a wall of the electrode with a nozzle.

12. The method according to claim 9, further comprising: intermittently actuating the injection device with a circuit.

13. The method according to claim 12, wherein the circuit is configured to activate the injection device during a low airflow time-period.

14. The method according to claim 9, further comprising:

mechanically cleaning with a cleaning brush to clean at least one of the emission electrode and the collecting electrode with a cleaning movement;

generating the cleaning movement through a change in a fill volume of a expansion tank; and guiding a fluid out of the expansion tank to reduce the fill volume and to direct the fluid to one of the injection device and the electrode.

15. A cleaner for an electric oil separator that separates oil from an airflow of a ventilator using the method according to claim 9.

16. An electric oil separator that separates oil from an airflow of a ventilator comprising:

a separator;

an emission electrode:

a collecting electrode; and an oil injector structured and arranged to inject oil obliquely to a longitudinal axis of the collecting electrode and onto a portion of the separator.

17. The electric oil separator according to claim 16, wherein the ventilator is a crankcase ventilator of an internal combustion engine.

18. The electric oil separator according to claim 16, wherein the injector, which is coupled to an oil supply through a feed line, further comprises:

an opening structured and arranged to direct the oil, as a cleaning fluid, at the portion of the separator.

19. The electric oil separator according to claim 16, further comprising:

a circuit configured to intermittently actuate the injector.

20. The electric oil separator according to claim 19, wherein the circuit is configured to activate the injector during a low airflow time-period.

21. An electric oil separator that separates oil from an airflow of a ventilator comprising:

a separator;

an injector structured and arranged to inject oil obliguely to a longitudinal axis of a collecting electrode and onto a portion of the separator;

a cleaning brush configured to mechanically clean the portion of the separator with a cleaning movement;

an expansion tank structured and arranged to generate the cleaning movement through a change in a fill volume of the expansion tank; and a supply line structured and arranged to guide a fluid out of the expansion tank and to reduce the fill volume and to direct the fluid to one of the injector and the electrode.

* * * * *